United States Patent [19]

Gray

[11] Patent Number: 4,882,788

[45] Date of Patent: Nov. 28, 1989

[54] PRECUT AND PARTIALLY ASSEMBLED CLOTHING

[75] Inventor: Thelma Gray, West Chester, Pa.

[73] Assignee: Made with Love, Inc., Philadelphia, Pa.

[21] Appl. No.: 229,079

[22] Filed: Aug. 5, 1988

[51] Int. Cl.[4] ..... A41D 27/00; A41D 1/00

[52] U.S. Cl. ..... 2/243 R; 2/243 B; 2/105

[58] Field of Search ..... 2/1, 105, 243 B, 243 R

[56] References Cited

U.S. PATENT DOCUMENTS

| | | | |
|---|---|---|---|
| 2,585,946 | 2/1952 | Liberman | 2/243 R X |
| 2,636,181 | 4/1953 | Becker | 2/243 B |
| 2,892,196 | 6/1959 | Pundyk et al. | 2/243 R |
| 3,523,304 | 8/1970 | Nobles | 2/243 R |

FOREIGN PATENT DOCUMENTS

| | | | |
|---|---|---|---|
| 555282 | 3/1957 | Belgium | 2/243 R |
| 2412627 | 9/1975 | Fed. Rep. of Germany | 2/243 B |
| 2399810 | 4/1979 | France | 2/243 B |
| 2481084 | 10/1981 | France | 2/243 R |
| 285296 | 2/1928 | United Kingdom | 2/243 R |
| 2098458 | 11/1982 | United Kingdom | 2/243 R |

OTHER PUBLICATIONS

Woodward & Lothrop Ad in *The Evening Star,* Washington, D.C., Jun. 17, 1952.

*Primary Examiner*—Werner H. Schroeder
*Assistant Examiner*—Sara M. Current
*Attorney, Agent, or Firm*—Caesar, Rivise, Bernstein, Cohen & Pokotilow

[57] ABSTRACT

An unfinished article of clothing is provided which includes a plurality of fabric panels to be sewn together along a plurality of seams. At least one seam connecting the plurality of panels is finished while the rest of the seams which will connect the panels together are unfinished and have a plurality of tacks along the locations of the seams which will fasten the panels together. The article of clothing is provided inside out for ease in finishing the seams.

5 Claims, 2 Drawing Sheets

PRECUT AND PARTIALLY ASSEMBLED CLOTHING

FIELD OF THE INVENTION

The present invention relates to clothing and in particular relates to clothing which is precut and partially assembled before being offered for sale to the consumer.

BACKGROUND OF THE INVENTION

Most clothing that is purchased is purchased as a final assembled product with no need for the purchaser to do any manual finishing of the product. If the purchaser wants to decrease the cost of the clothing, the only alternative presently available is to purchase clothing patterns and fabric by the yard, and then, the pattern must be laid out on the fabric, cut, assembled and the clothing finished. Because time is so valuable these days, very few people have the time to go through all of the steps of purchasing fabric, laying out the pattern on fabric, cutting the fabric, partially assembling the garment, sizing the garment, and then completing the garment. This means, of course, that unless the purchaser has time to through all these steps the purchaser is left with no alternative but to pay the price of a completely assembled article of clothing.

If, on the other hand, some of the tedious steps, such as purchasing the fabric, cutting out the pattern, and at least partially assembling the article of clothing can be achieved on a large scale, then it might be possible to economically purchase partially assembled clothing which the purchaser can, in a short period of time, complete. Furthermore, such a product will cost less than buying a totally finished product. For children's clothing which has only a limited service life, anyway, an economical type of clothing which is economical and can be easily completed would be beneficial.

OBJECT OF THE INVENTION

With this background in mind it is an object of the present invention to provide an article of clothing which is precut and partially assembled before being sold.

It is also an object of the invention to provide a precut and partially assembled article of clothing which has some seams that are completely sewn and other seams which are only tacked and for finishing need to be sewn by the purchaser.

It is a further object of the invention to provide an article of clothing which is less expensive to acquire because many of the finishing steps are completed by the purchaser.

SUMMARY OF THE INVENTION

In furtherance of these objectives, a precut and partially assembled, but unfinished, article of clothing is provided which includes a plurality of fabric panels adapted to be seamed together. At least one of the seams connecting all of the panels is prefinished while the remaining seams connecting the panels are unfinished and held together by a plurality of tacks along the seam locations. The article of clothing is provided inside out so that the tacked seams may be easily finished by the purchaser.

One of the major benefits of providing such a piece of clothing is that it obviates the need for the purchaser to handle patterns and cut out fabrics, and moreover, saves the cost involved in having someone else hand-finish the item of clothing, because that is done by the purchaser.

BRIEF DESCRIPTION OF THE DRAWINGS

Other objects and many of the attendant advantages of the instant invention will be readily apparent as the same becomes better understood by reference to the following detailed description when considered in conjunction with the accompanying drawings, wherein.

DETAILED DESCRIPTION OF THE PREFERRED EMBODIMENTS

Figure 1:
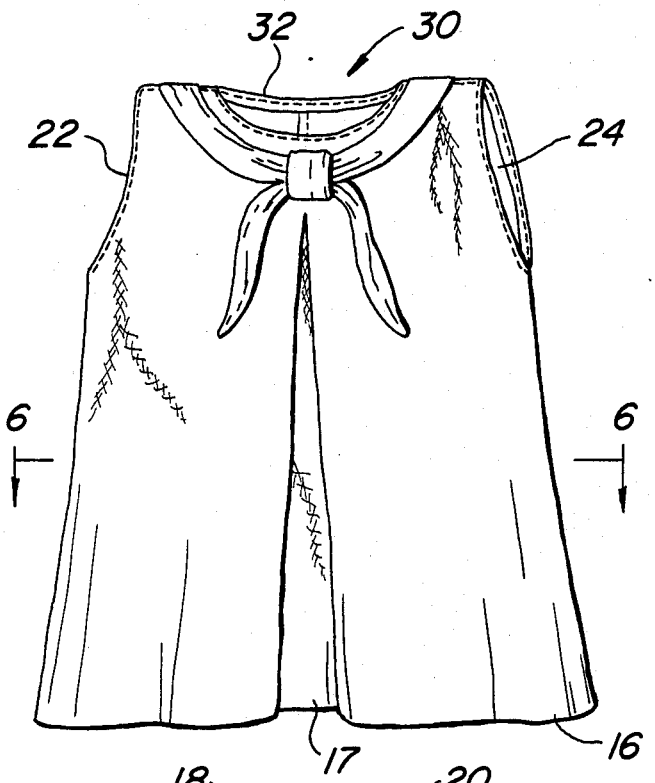
FIG. 1 is an isometric view of a completed article of clothing according to the present invention.
Figure 2:
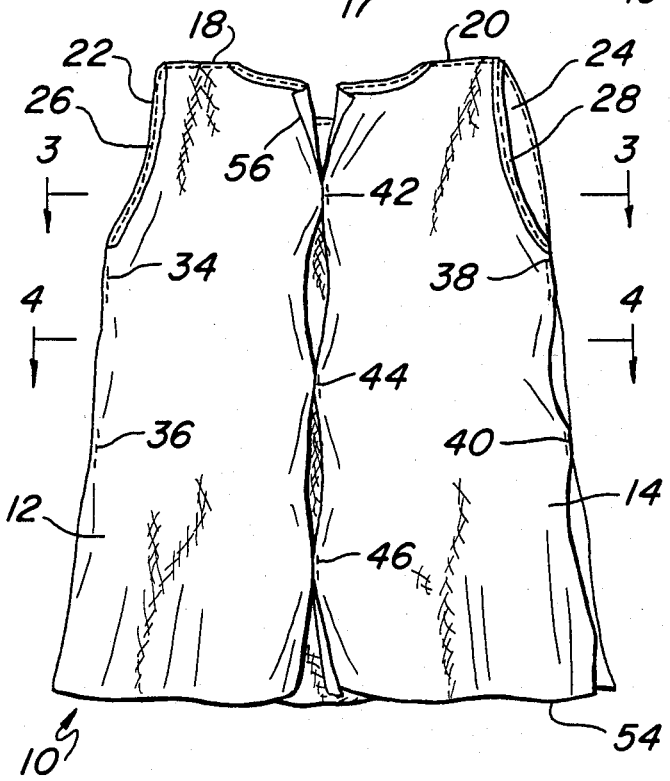
FIG. 2 is a rear view of the article of clothing of the present invention, turned inside out and before finishing.
Figure 3:
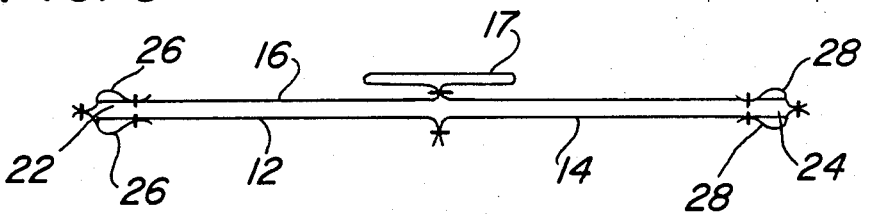
FIG. 3 is a section view taken along the line 3—3 in FIG. 2.

Referring in greater detail to the various figures of the drawings wherein like reference characters refer to like parts, an article of clothing, not fully completed or finished, according to the present invention is generally shown at 10 in FIG. 2. As more fully shown in FIG. 1, a preferred embodiment of the article of clothing of the present invention, when fully completed, is a dress. The dress, however, as shown in FIG. 2 is only partially completed and consists of essentially three panels, two rear panels 12, 14 and a front panel 16 with a long pleat 17 formed therein.

The three panels 12, 14 and 16 are precut before being delivered to the consumer and are seamed together across the shoulders 18, 20. The armhole openings 22, 24 are finished with seams 26, 28, respectively, to decrease the purchaser's finishing time. The neckline 30 is finished with a seam 32 therearound in both the back panels 12, 14 and the front panel 16.

It can be realized that by finishing the armholes, the shoulders and the neck opening, all that needs to be completed is to size the garment and finish the remaining seams according to the size of the future wearer.

As seen in FIG. 2, one back panel 12 is tacked to the front panel at locations 34, 36, while the other back panel 14 is tacked to the front panel 16 at locations 38, 40. The two back panels are also tacked to each other at locations 42, 44 and 46. These various tacked locations form the article of clothing substantially into its finished shape and define the locations where the finished seams are to be located.

Figure 4:
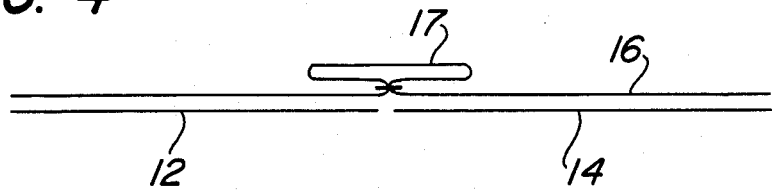
FIG. 4 is a section view taken along the line 4—4 in FIG. 2.
Figure 5:
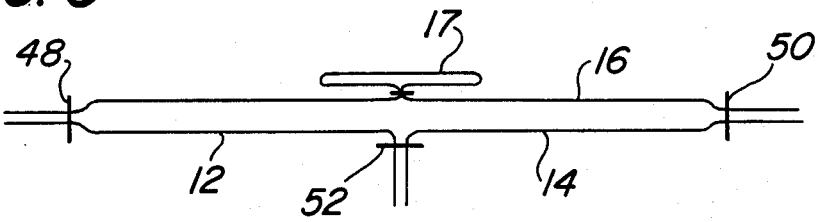
FIG. 5 is a view similar to FIG. 4 showing the placement of the finishing seams.

Viewing FIGS. 4 and 5, FIG. 4 shows locations where the three clothing panels 12, 14 and 16 are not tacked together in one instance (FIG. 4) and the location of the finished seams 48, 50 and 52 which complete the article. (FIG. 5)

Figure 6:
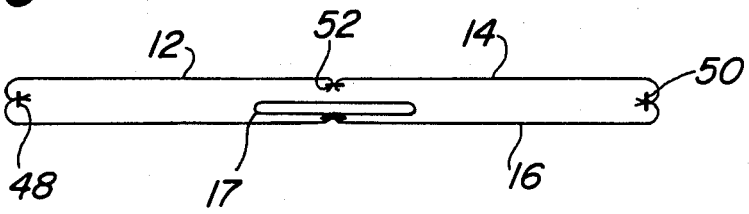
FIG. 6 is a cross-sectional view taken along the line 6—6 of FIG. 1.

FIG. 6 shows a cross-section of the dress 10 turned right side out with all of the seams finished. The article of precut and partially assembled clothing 10, in this instance a dress, is provided to the customer with the wrong side out (FIG. 2) so that it is ready for the customer to sew. While the more complicated seams 26, 28 at the armholes 22, 24 and the shoulder seams 18, 20 are already finished, the sides and back have not been seamed and are held in place only by the various tacked portions 34 36, 38, 40, 42, 44 and 46.

The first step in completing the garment is to sew the back seam 52 (FIG. 5) by hand or machine starting at the top tack 42. One-quarter inch should be allowed for the seam. By leaving the seam unfinished above the tack, the clothing may be slipped over the head of the wearer to adjust the hem and side seams, if necessary.

After the back seam 52 is completed, each side seam 48, 50 is sewn from the armholes 22, 24 to the hem 54. Again, each seam should be about one-quarter of an inch.

At this point, after these three seams 48, 50 and 52 are completed, the article is turned right side out and tried on the wearer. With the garment in place the hem 54 can be pinned in place. After the garment is removed from the wearer, the hem can be completed.

The final step in completing the basic garment itself is to finish the back of the neckline 56 above the first tack 42 and to sew a hook on one side and an eye on the other (not shown) in order to hold the neckline closed.

Once the garment is completed, any additional trimming, such as lace around the neck or sashes, can be sewn into place.

Without further elaboration, the foregoing will so fully illustrate my invention that others may, by applying future knowledge, adopt the same for use under various conditions of service.

What is claimed as the invention is:

1. An unfinished article of clothing comprising:

a plurality of fabric panels adapted to be sewn together along a plurality of seams, said panels having at least one finished seam connecting said panels; and a plurality of tacks fastening said panels to each other along the remaining seams along which said panels are to be sewn together.

2. An article of clothing as claimed in claim 1, wherein:

said unfinished article of clothing is a dress comprised of a front panel and two rear panels, said front and rear panels being at least partially seamed together along the top edges thereof; and said two rear panels of said dress are tacked to each other at a location where said rear panels will be seamed together and each rear panel is tacked to said front panel at the location where each rear panel will be seamed to said front panel.

3. An unfinished article of clothing as claimed in claim 1, wherein said unfinished article of clothing is inside out.

4. An unfinished article of clothing as claimed in claim 1, further comprising:

at least one article of trim to be attached to at least one of said fabric panels.

5. A kit for producing an article of clothing comprising:

a plurality of fabric panels adapted to be sewn together along a plurality of seams, said panels having at least one finished seam connecting said panels to each other, a plurality of tacks fastening the remaining seams along which said panels are to be sewn together; and at least one article of trim to be attached to at least one of said panels.

* * * * *